US007682559B2

(12) United States Patent
Hamada et al.

(10) Patent No.: US 7,682,559 B2
(45) Date of Patent: Mar. 23, 2010

(54) CR-BEARING HEAT-RESISTANT STEEL SHEET EXCELLENT IN WORKABILITY AND METHOD FOR PRODUCTION THEREOF

(75) Inventors: Junichi Hamada, Chuo-ku (JP); Naoto Ono, Chuo-ku (JP); Akihiko Takahashi, Chuo-ku (JP); Tadashi Komori, Chuo-ku (JP)

(73) Assignee: Nippon Steel Corporation, Tokyo (JP)

( * ) Notice: Subject to any disclaimer, the term of this patent is extended or adjusted under 35 U.S.C. 154(b) by 1031 days.

(21) Appl. No.: 10/504,453

(22) PCT Filed: Dec. 12, 2003

(86) PCT No.: PCT/JP03/15988

§ 371 (c)(1),
(2), (4) Date: Aug. 11, 2004

(87) PCT Pub. No.: WO2004/053171

PCT Pub. Date: Jun. 24, 2004

(65) Prior Publication Data

US 2005/0161133 A1 Jul. 28, 2005

(30) Foreign Application Priority Data

Dec. 12, 2002 (JP) ..... 2002-360567

(51) Int. Cl.
*C22C 38/26* (2006.01)
*C21D 8/02* (2006.01)

(52) U.S. Cl. ..... 420/34; 420/61; 420/69; 148/602

(58) Field of Classification Search ..... 420/34, 420/61, 69; 148/602
See application file for complete search history.

(56) References Cited

U.S. PATENT DOCUMENTS

| | | | | |
|---|---|---|---|---|
| 4,374,683 | A | 2/1983 | Koike et al. | |
| 2002/0129877 | A1 * | 9/2002 | Liesert et al. | 148/325 |

FOREIGN PATENT DOCUMENTS

| | | | |
|---|---|---|---|
| EP | 765941 | | 4/1997 |
| EP | 1207214 | | 5/2002 |
| EP | 1219719 | | 7/2002 |
| EP | 1225242 | | 7/2002 |
| JP | 53044420 | | 4/1978 |
| JP | 03264652 | | 11/1991 |
| JP | 05-179357 | * | 7/1993 |
| JP | 06-184637 | * | 7/1994 |
| JP | 07070718 | | 3/1995 |
| JP | 08199235 | | 8/1996 |
| JP | 09279312 | | 10/1997 |
| JP | 10121205 | | 5/1998 |
| JP | 2002030346 | | 1/2002 |

* cited by examiner

*Primary Examiner*—Roy King
*Assistant Examiner*—Jessee R. Roe
(74) *Attorney, Agent, or Firm*—Baker Botts LLP

(57) ABSTRACT

A Cr-bearing heat-resistant steel sheet with excellent workability comprising, in mass %, C of 0.001% to 0.010%, Si of 0.01% to 0.60%, Mn of 0.05% to 0.60%, P of 0.01% to 0.04%, S of 0.0005% to 0.0100%, Cr of 14% to 19%, N of 0.001% to 0.020%, Nb of 0.3% to 1.0%, Mo of 0.5% to 2.0% and, as required, one or more of Cu of 0.5% to 3.0%, W of 0.01% to 1.0% and Sn of 0.01% to 1.00%, and/or one or more of Ti of 0.01% to 0.20%, Al of 0.005% to 0.100%, Mg of 0.0002% to 0.0100%, and B of 0.0003% to 0.001%, with the remainder comprising iron and unavoidable impurities, and having an x-ray intensity ratio {111}/({100}+{211}) of 2 or greater in the central region of thickness.

6 Claims, 4 Drawing Sheets

CR-BEARING HEAT-RESISTANT STEEL SHEET EXCELLENT IN WORKABILITY AND METHOD FOR PRODUCTION THEREOF

CROSS-REFERENCE TO RELATED APPLICATION(S)

The application is a national phase application of International Patent Application No. PCT/JP03/15988 filed on Dec. 12, 2003, and which published on Jun. 24, 2003 as International Patent Publication No. WO 03/053171. Accordingly, the present application claims priority from the above-referenced International application under 35 U.S.C. § 365. In addition, the present application claims priority from Japanese Patent Application No. 2002-360567 filed Dec. 12, 2002 under 35 U.S.C. § 119. The entire disclosures of these International and Japanese patent applications are incorporated herein by reference.

FIELD OF THE INVENTION

The present invention relates to a Cr-bearing heat-resistant steel with an excellent workability to be usable, e.g., for a material for an automotive exhaust system that has high-temperature strength and oxidation resistance.

BACKGROUND INFORMATION

Cr-bearing heat-resistant steel sheets are used for exhaust manifolds, mufflers and other exhaust system members that require high-temperature strength and oxidation resistance. As these members are manufactured by press-forming, the steel sheets should have press formability.

Meanwhile, the service temperature for these members rises year after year. To cope with this temperature rise, it has been preferable to enhance the high-temperature strength of the material steel sheets by increasing the addition of Cr, Mo, Nb and other alloying elements.

The addition of alloying elements by simple manufacturing methods, however, has at times, lowered the workability of material steel sheets to such a level as to make press forming likely impossible.

Increasing the cold reduction ratio is conducive to effectively increasing the "r" value that is an index of press formability of steel sheets. However, the material steel sheets for such exhaust system members are relatively thick (e.g., between approximately 1.5 mm and 2 mm). Therefore, the conventional manufacturing processes that limit the thickness of cold-rolled strip to within a certain range do not permit securing sufficient cold reduction ratios.

In order to solve the above-described problem by increasing the "r" value, which is an index of press formability, without impairing the high-temperature properties, various studies have been made regarding the chemical composition and manufacturing method of steel sheets.

Conventionally, the workability of Cr-bearing heat-resistant steels has been improved by adjusting the chemical composition as described in, for example, Japanese Patent Publication No. 09-279312. However, composition adjustment alone may not be enough to solve the problems, such as cracks caused by pressing, in thicker materials manufactured with relatively low reduction ratios.

Japanese Patent Publication No. 2002-30346 describes a method that specifies the optimum hot-rolled strip annealing temperature based on the relationship between the hot-rolling starting and finishing temperatures, Nb content and annealing temperature. However, the specification of the hot-rolled strip annealing temperature alone is sometimes not enough where there are effects of elements (C, N, Cr, Mo, etc.) that are related to Nb-bearing precipitates.

Japanese Patent Publication No. 08-199235 describes a method that applies aging treatment to hot-rolled steel strip for more than one hour. This method, however, has a drawback that commercial manufacturing efficiency is extremely low.

SUMMARY OF THE INVENTION

One of the objects of the present invention is to provide a Cr-bearing heat-resistant steel sheet having workability and a method of manufacturing the same by solving certain problems that exist in conventional technologies.

Accordingly, one exemplary embodiment of a Cr-bearing heat-resistant steel sheet is provided with excellent workability. The sheet may include, in mass %, C of 0.001% to 0.010%, Si of 0.01% to 0.60%, Mn of 0.05% to 0.60%, P of 0.01% to 0.04%, S of 0.0005% to 0.0100%, Cr of 14% to 19%, N of 0.001% to 0.020%, Nb of 0.3% to 1.0%, Mo of 0.5% to 2.0%, with the remainder comprising iron and unavoidable impurities, and having an x-ray intensity ratio $\{111\}/(\{100\}+\{211\})$ of 2 or greater in the central region of thickness. The sheet may also include, in mass %, one or more of Cu of 0.5% to 3.0%, W of 0.01% to 1.0% and Sn of 0.01% to 1.00%. In addition, the sheet may contain, in mass %, one or more of Ti of 0.01% to 0.20%, Al of 0.005% to 0.100%, Mg of 0.0002% to 0.0100% and B of 0.0003% to 0.001%.

According to another exemplary embodiment of the present invention, a method for manufacturing Cr-bearing heat-resistant steel sheet with excellent workability is provided. In this exemplary method, a steel sheet is hot-rolled. Such sheet includes, in mass %, C of 0.001% to 0.010%, Si of 0.01% to 0.60%, Mn of 0.05% to 0.60%, P of 0.01% to 0.04%, S of 0.0005% to 0.0100%, Cr of 14% to 19%, N of 0.001% to 0.020%, Nb of 0.3% to 1.0%, Mo of 0.5% to 2.0% and, if needed, one or more of Cu of 0.5% to 3.0%, W of 0.01% to 1.0% and Sn of 0.01% to 1.00%, and/or, one or more of Ti of 0.01% to 0.20%, Al of 0.005% to 0.100%, Mg of 0.0002% to 0.0100%, and B of 0.0003% to 0.001%, with the remainder comprising iron and unavoidable impurities, with a heating temperature of 1000° C. to 1150° C. and a finishing temperature of 600° C. to 800° C. The sheet (e.g., the hot-rolled strip) may be coiled at a temperature that is not higher than 500° C. The coiled hot-rolled metal sheet/strip can be heated to a temperature of between 900° C. and 1000° C. Further, such sheet/strip may be cooled to a temperature of 300° C. at a rate of 30° C./sec or faster, with subsequent pickling, cooling and annealing.

According to a further exemplary embodiment of the present invention, a method for manufacturing Cr-bearing heat-resistant steel sheet with excellent workability is provided. In this exemplary method, a steel sheet is hot-rolled. Such sheet includes, in mass %, C of 0.001% to 0.010%, Si of 0.01% to 0.60%, Mn of 0.05% to 0.60%, P of 0.01% to 0.04%, S of 0.0005% to 0.0100%, Cr of 14% to 19%, N of 0.001% to 0.020%, Nb of 0.3% to 1.0%, Mo of 0.5% to 2.0% and, if needed, one or more of Cu of 0.5% to 3.0%, W of 0.01% to 1.0% and Sn of 0.01% to 1.00%, and/or, one or more of Ti of 0.01% to 0.20%, Al of 0.005% to 0.100%, Mg of 0.0002% to 0.0100%, and B of 0.0003% to 0.001%, with the remainder comprising iron and unavoidable impurities, with a heating temperature of 1000° C. to 1150° C. and a finishing temperature of 600° C. to 800° C. The hot-rolled metal (or strip) is coiled at a temperature not higher than 500° C. The coiled hot-rolled metal sheet/strip is recrystallized, and the metal strip is maintained at a temperature of 900° C. to 1000° C. for not less than 60 seconds. Further, the metal sheet/strip is cooled to a temperature of 300° C. at a rate of 30° C./sec or faster, with subsequent pickling, cooling and annealing.

According to a further exemplary embodiment of the present invention, a method for manufacturing Cr-bearing heat-resistant steel sheet with excellent workability is provided. In this exemplary method, a steel sheet is hot-rolled. Such sheet includes, in mass %, C of 0.001% to 0.010%, Si of 0.01% to 0.60%, Mn of 0.05% to 0.60%, P of 0.01% to 0.04%, S of 0.0005% to 0.0100%, Cr of 14% to 19%, N of 0.001% to 0.020%, Nb of 0.3% to 1.0%, Mo of 0.5% to 2.0% and, if needed, one or more of Cu of 0.5% to 3.0%, W of 0.01% to 1.0% and Sn of 0.01% to 1.00%, and/or, one or more of Ti of 0.01% to 0.20%, Al of 0.005% to 0.100%, Mg of 0.0002% to 0.0100%, and B of 0.0003% to 0.001%, with the remainder comprising iron and unavoidable impurities, with a heating temperature of 1000° C. to 1150° C. and a finishing temperature of 600° C. to 800° C. The hot-rolled metal (or strip) is coiled at a temperature not higher than 500° C. The coiled hot-rolled metal sheet/strip can be maintained at a temperature of 750° C. to 950° C. for 1 hour to 30 hours. Further, the metal sheet/strip may be cooled to a temperature of 300° C. at a rate of 30° C./sec or faster, with subsequent pickling, cooling and annealing.

The entire disclosures of all publications referenced above are incorporated herein by reference.

DETAILED DESCRIPTION

Figure 1:
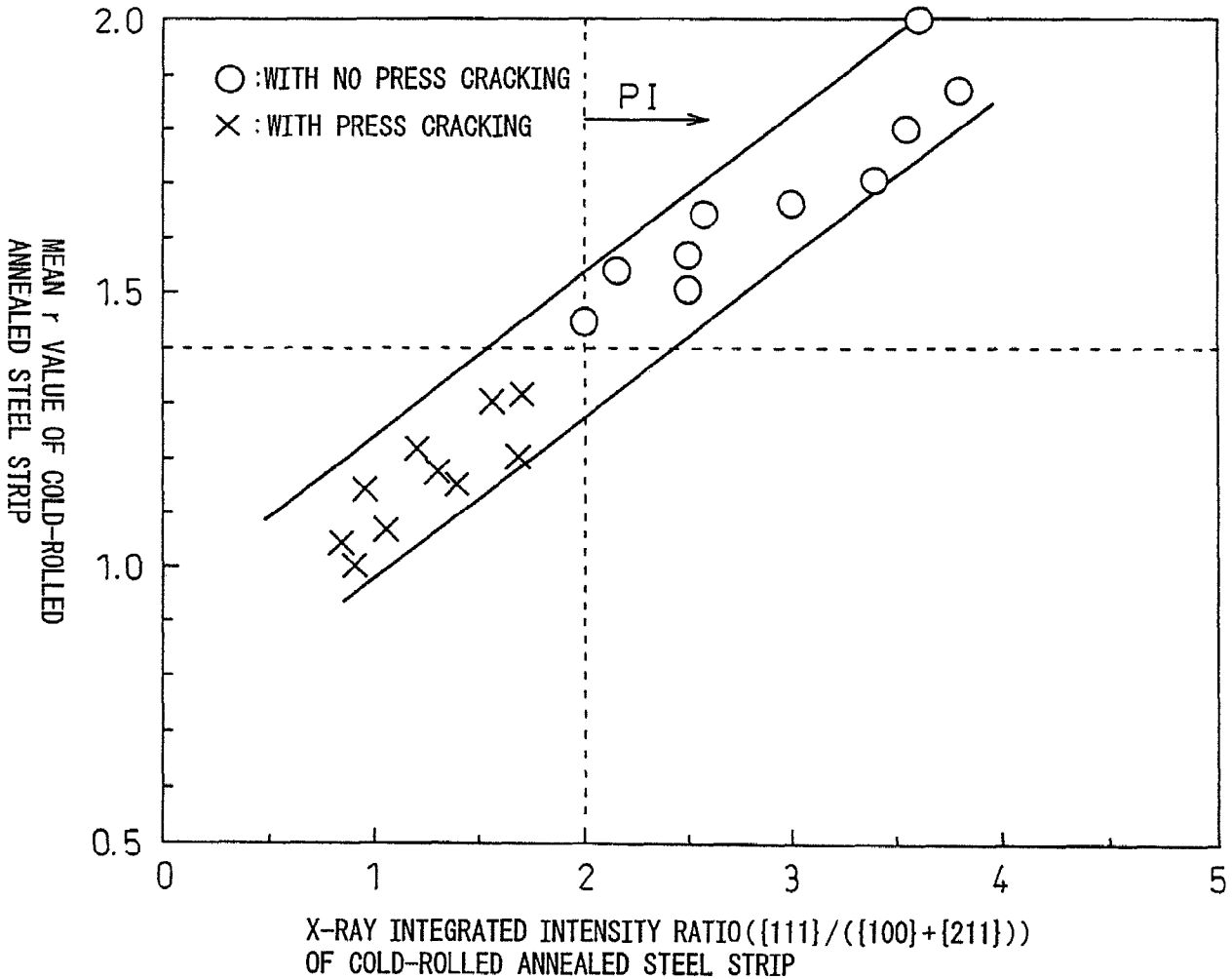
FIG. 1 shows an exemplary relationship between x-ray intensity ratio {111}/({100}+{211}) and "r" value of manufactured steel sheets.

For the purpose of describing the exemplary embodiments of the present invention, "%" is used in below to describe "mass %".

C generally deteriorates workability and corrosion resistance. Therefore, the smaller the content thereof, the better. This is the reason why the upper limit of the content of C is preferably set at 0.010%. The lower limit is preferably set at 0.001% because excessive reduction brings about a refining cost increase. When considering manufacturing cost and corrosion resistance, it is preferable to limit the carbon content to between about 0.002 and 0.005%.

Si, which is sometimes added as a deoxidizing element, is also a solid solution strengthening element. From the viewpoint of material properties, therefore, the smaller the content thereof, the better. Thus, the upper limit is preferably set at 0.60%. To secure good resistance to oxidation, the lower limit is preferably set at 0.01%. However, a further preferable lower limit may be 0.30% because excessive reduction brings about a refining cost increase. When considering material properties, the preferable upper limit is 0.50%.

Mn, like Si, is a solid solution strengthening element. From the viewpoint of material properties, therefore, the smaller the content thereof, the better. Thus, the upper limit is preferably set at 0.60%, whereas the lower limit is preferably set at 0.05% in order to secure good scale adhesion. However, a further preferable lower limit is 0.30% because excessive reduction leads to a refining cost increase. When considering material properties, the preferable upper limit is 0.50%.

P, like Mn and Si, is a solid solution strengthening element. From the viewpoint of material properties, therefore, the smaller the content thereof, the better. Therefore, the upper limit is preferably set at 0.04%. The lower limit is preferably set at 0.01% because excessive reduction brings about a refining cost increase. When considering manufacturing cost and corrosion resistance, a further preferable content is between 0.02% and 0.03%.

From the viewpoint of material properties and corrosion resistance, the smaller the content of S, the better. Thus, the upper limit is preferably set at 0.0100%, whereas the lower limit is preferably set at 0.0005% because excessive reduction brings about a refining cost increase. When considering manufacturing cost and corrosion resistance, a further preferable content is between 0.0020% and 0.0060%.

It is preferable to add Cr of not less than 14% for the improvement of corrosion and oxidation resistance. However, addition in excess of 19% deteriorates toughness, manufacturability and material properties in general. So, Cr content is limited between 14% and 19%. A further preferable content to secure good corrosion resistance and high-temperature strength is 14% to 18%.

As N, like C, deteriorates workability and corrosion resistance, the smaller the content thereof, the better. Therefore, the upper limit is preferably set at 0.020%. The lower limit is preferably set at 0.001% because excessive reduction brings about a refining cost increase. When considering manufacturing cost, workability and corrosion resistance, a further preferable content is 0.004% to 0.010%.

From the viewpoint of solid-solution and precipitation strengthening, Nb is preferable for the improvement of high-temperature strength. Nb fixes C and N as carbonitrides and affects the development of recrystallized aggregate structure, that is, x-ray intensity ratio {111}/({100}+{211}) of manufactured strip. As the above-described action of Nb appears when the content is not less than about 0.3%, the lower limit is set at about 0.3%.

As this invention improves workability by controlling Nb-precipitates (in particular, the Laves phase that comprises intermetallic compounds consisting essentially of Fe, Cr, Nb and Mo) before cold-rolling, there should be a sufficient quantity of Nb to fix C and N. As, however, the effect saturates at 1.0%, the upper limit is set at 1.0%. When considering manufacturing cost and manufacturability, the preferable content is about 0.4% to 0.7%.

Mo should be included in heat-resistant steels as an element for increasing corrosion resistance and controlling high-temperature oxidation. Mo also forms Laves phase. To improve workability by controlling the formation of Laves phase, Mo of not less than 0.5% may be needed.

If Mo content is lower than 0.5%, the Laves phase preferable for developing the recrystallized aggregate structure does not precipitate and, as a result, does not increase the x-ray intensity ratio {111}/({100}+{211}) of manufactured steel sheets. Therefore, the lower limit of Mo content is preferably set at 0.5%.

As, however, excessive addition deteriorates toughness and lowers elongation properties, the upper limit is preferably set at 2.0%. When considering manufacturing cost and manufacturability, a further preferable content is 1.0% to 1.5%.

Cu is added as required for increasing corrosion resistance and high-temperature strength. Addition of Cu of preferably not less than 0.5% precipitates ε-Cu and, thereby, increases the x-ray intensity ratio {111}/{100}+{211}). Therefore, the lower limit set at 0.5%.

As, however, excessive addition lowers elongation properties and deteriorates manufacturability, the upper limit is preferably set at 3.0%. When considering manufacturing cost and manufacturability, the preferable content is preferably 1.0% to 2.0%.

W is added as required for increasing high-temperature strength. As this action appears when W of preferably not less than 0.01% is added, the lower limit is preferably set at 0.01%. As, however, excessive addition lowers manufacturability and workability, the upper limit is preferably set at 1.0%. When considering high-temperature properties and manufacturing cost, the preferable content is about 0.05% to 0.5%.

Sn is added as required for increasing high-temperature strength and lowers recrystallization temperature by segregating at grain boundaries. As this action appears when Sn of preferably not less than 0.01% is added, the lower limit is preferably set at 0.01%. As, however, excessive addition deteriorates workability and tends to form surface defects during manufacturing, the upper limit is preferably set at 1.00%. When considering high-temperature properties and manufacturing cost, a further preferable content is about 0.05% to 0.50%.

Ti is added as being preferable for further improving corrosion resistance, intergranular corrosion resistance and deep drawability by combining with C, N and S. As the action to increase the x-ray intensity ratio {111}/({100}+{211}) appears when the content is preferably not lower than 0.01%, the lower limit is preferably set at 0.01%.

A combined addition of Ti and Nb improves high-temperature strength and contributes to the improvement of oxidation resistance. However, excessive addition impairs manufacturability in the steelmaking process, induces defect formation in the cold-rolling process and brings about deterioration of material properties by increasing solid solution of Ti. Therefore, the upper limit is preferably set at 0.20%. When considering manufacturing cost, a further preferable content is 0.03% to 0.10%.

Al is sometimes added as a deoxidizing element. As the deoxidizing action appears when the content is not less than 0.005%, the lower limit is preferably set at 0.005%. As addition in excess of 0.100% lowers elongation properties and deteriorates weldability and surface quality, the upper limit is set at 0.100%. When considering a refining cost, a further preferable content is 0.010% to 0.070%.

Mg forms Mg-oxide in molten steel and acts as a deoxidizing agent together with Al. Fine precipitation of Nb— or Ti-precipitates occurs around finely crystallized Mg-oxide. When these precipitates finely precipitate in the hot-rolling process, very fine recrystallized structures are formed around the fine precipitates, thereby increasing the x-ray intensity ratio {111}/({100}+{211}) and remarkably improving the workability of cold-rolled annealed steel sheets. As this action appears when the content is preferably not lower than 0.0002%, the lower limit is preferably set at 0.0002%.

As, however, excessive addition lowers weldability, the upper limit is preferably set at 0.0100%. When considering refining cost, a further preferable content is 0.0005% to 0.0020%.

B of not less than 0.0003% is added for improving cold workability and fabricability of manufactured steel sheets. However, addition in excess of 0.001% deteriorates ductility and deep drawability. Therefore, the upper limit is preferably set at 0.001%. A further preferable content is 0.0005% to 0.0010%.

Further, the relationship between the x-ray intensity ratio and "r" value is discussed below.

The "r" value, which is an indicator of workability, is related to the recrystallized aggregate structure. Generally, the "r" value improves if the ratio of plane direction {111} to {100}, i.e. ({111}/{100}), is increased. Through an investigation that takes into consideration of the influences of other plane directions as well, the inventors discovered that plane direction {211} too should be considered for the improvement of the "r" value.

FIG. 1 shows the relationship between the x-ray intensity ratio {111}/({100}+{211}), and mean "r" value in the central region of thickness of cold-rolled annealed Cr-bearing heat-resistant steel sheet (containing C of 0.003%, Si of 0.5%, Mg of 0.5%, P of 0.02%, S of 0.001%, Cr of 14.5%, Nb of 0.6%, Mo of 1.4% and N of 0.01%) that affects cracking during pressing.

The x-ray intensity ratio plotted along the horizontal axis was derived from the x-ray intensity strength measured on different crystal faces in the central region of thickness of cold-rolled annealed steel sheet and the intensity ratio of non-oriented steel specimens.

The mean "r" value plotted along the vertical axis may be derived by applying 15% in the rolling direction and directions 45° and 90° away therefrom on JIS 13B tensile test specimens taken from cold-rolled annealed steel sheet and using equations (1) and (2).

$$r=1n(W_0/W)/1n(t_0/t) \quad (1)$$

where $W_0$ is the sheet width before application of strain, W is the sheet width after application of strain, $t_0$ is the sheet thickness before application of strain, and t is the sheet thickness after application of strain.

$$\text{Mean } r \text{ value}=(r_0+2r_{45}+r_{90})/4 \quad (2)$$

where $r_0$ is the "r" value in the rolling direction, $r_{45}$ is the "r" value in a direction 45 degrees away from the rolling direction, and $r_{90}$ is the "r" value in a direction 90 degrees away from the rolling direction.

As shown in FIG. 1, the x-ray intensity ratio {111}/({100}+{211}) and "r" value are in a proportional relationship and, therefore, the "r" value improves as the x-ray intensity ratio {111}/({100}+{211}) increases. When the x-ray intensity ratio {111}/({100}+{211}) is 2 or above (in the range PI in the figure), the mean "r" value is 1.4 or above, which means that workability is high enough to permit fabrication of general exhaust system members.

It has been determined that controlling the formation of Nb-based precipitates improves the "r" value.

Figure 2:
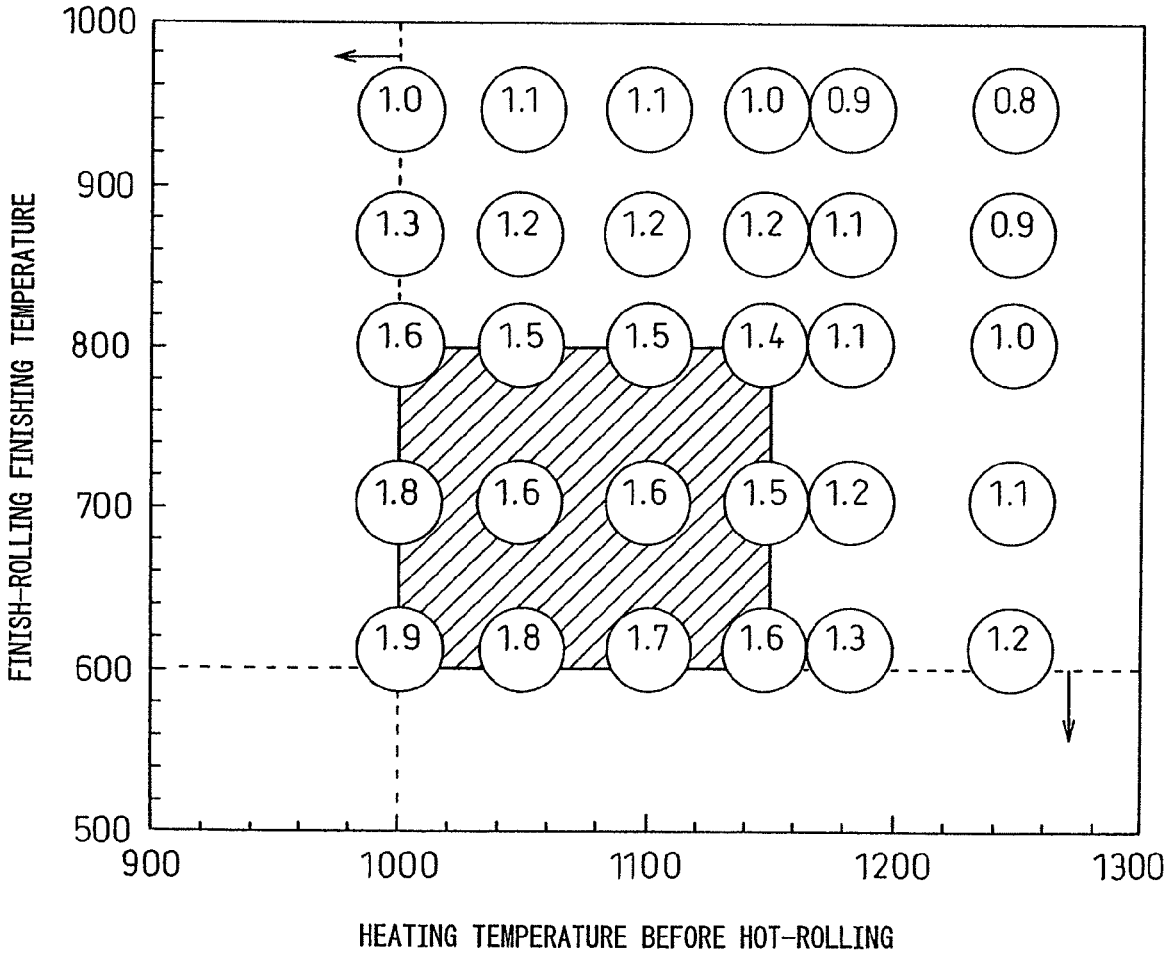
FIG. 2 shows an exemplary relationship between a slab heating temperature and the "r" value of manufactured strip.

FIG. 2 shows exemplary influences of heating and finishing-rolling temperatures on the "r" value of Cr-bearing heat-resistant steel sheet (containing C of 0.003%, Si of 0.5%, Mn of 0.5%, P of 0.02%, S of 0.001%, Cr of 14.5%, Nb of 0.6%, Mo of 1.4% and N of 0.01%) prepared by hot-rolling to a thickness of 5.0 mm with a coiling temperature of 500° C. and annealing temperature of 950° C. and cold-rolling to a thickness of 1.5 mm with an annealing temperature of 1050° C.

In FIG. 2, the circled numbers designate the mean "r" values. As shown in FIG. 2, "r" values 1.4 or above can be obtained by heating at 1000° C. to 1150° C and finishing-rolling at 600° C. to 800° C. (See hatched area in FIG. 2).

If the temperatures are outside the range specified according to the exemplary embodiments of the present invention, appropriate precipitates may be unobtainable in the manufacturing process. As a consequence, the x-ray intensity ratio of cold-rolled steel strip is out of the preferable range and the preferable "r" value may not be obtained.

If the heating temperature is under 1000° C. and/or the finishing-rolling temperature is under 600° C. (see the area indicated by arrow in the figure), many surface defects due to seizure with hot-rolling rolls are formed. Such surface defects significantly deteriorate the surface quality and become the starting point of cracking during pressing. Therefore, the lower limits of the heating and finishing-rolling temperatures are respectively set at 1000° C. and 600° C.

One of the reasons why the exemplary embodiments of the present invention can improve the "r" value is that fine recrystallization is achieved by implementing hot-rolling at low temperature, increasing stored strain and accelerating recrystallization in the subsequent annealing process. With the chemical composition according to the exemplary embodiments of the present invention, Nb-based precipitates precipitate at 1200° C. or below. During hot-rolling, therefore, a working strain is introduced around the finely precipitated Nb-based precipitates in the mother phase.

In order to accumulate strain in hot-rolling, it is preferable to increase stored strain by coiling the finish-rolled strip at low temperature. Therefore, coiling at a low temperature may be. As stored strain does not recover if the coiling temperature is not higher than 500° C., the coiling temperature is preferably set at a temperature of preferably not higher than 500° C. As, however, an excessively low temperature leads to malformed strip, a further preferable temperature is about 400° C. to 500° C.

Hot-rolled steel strip is generally annealed for securing desired properties by recrystallizing the ferrite structure. The basic metallurgical principle for improving the "r" value is to refine the ferrite structure in hot-rolled annealed steel before cold-rolling, facilitate the introduction of strain from grain boundaries, and develop the crystal orientation (such as {111}<112>) that improves the "r" value during annealing of cold-rolled steel sheet.

However, to improve the "r" value by controlling the quantity and size of Nb-based precipitates, even without forming recrystallized structure by annealing hot-rolled steel strip.

Figure 3:
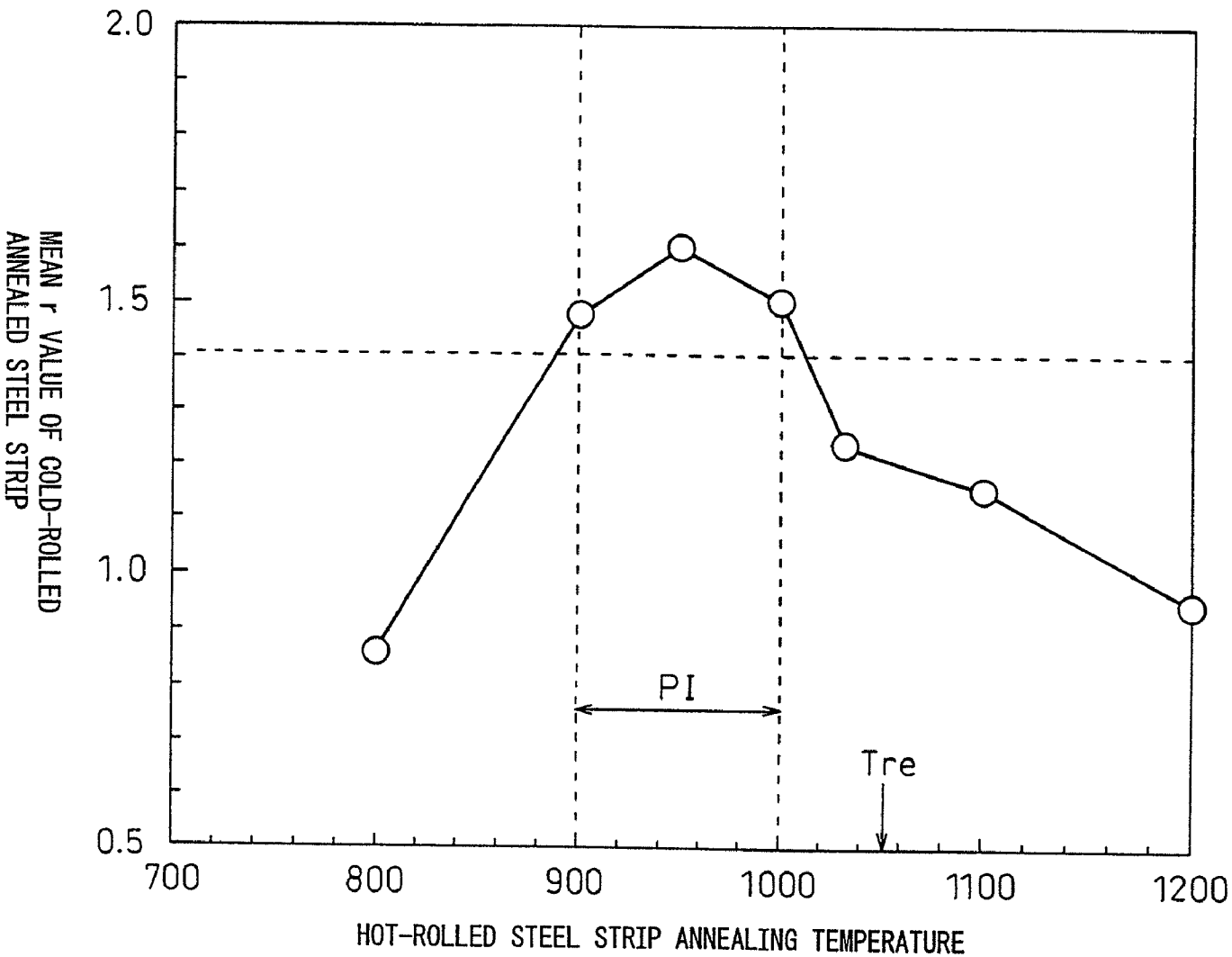
FIG. 3 shows an exemplary relationship between an annealing condition of hot-rolled strip and the "r" value of manufactured strip.

FIG. 3 shows the relationship between the annealing temperature of hot-rolled steel strip and the mean "r" value of cold-rolled annealed steel strip prepared by annealing hot-rolled strip of Cr-bearing heat-resistant steel strip (containing C of 0.003%, Si of 0.5%, Mg of 0.5%, P of 0.02%, S of 0.001%, Cr of 14.5%, Nb of 0.6%, Mo of 1.4% and N of 0.01%) and cold-rolling to 300° C. at a rate of approximately 30° C./sec, with a slab heating temperature of about 1150° C., a coiling temperature of about 500° C., hot-rolled strip thickness of 5.0 mm, cold-rolled strip thickness of 1.5 mm and cold-rolled strip annealing temperature of 1050° C.

FIG. 3 shows that the "r" value of the cold-rolled annealed steel strip becomes 1.4 or higher (see the range PI in the figure) by heating the hot-rolled strip to between 900° C. and 1000° C. and cold-rolling to 300° C. at a rate of 30° C./sec.

Though the structure of the hot-rolled steel strip is not recrystallized in the temperature range between about 900° C. and 1000° C. as the recrystallizing temperature thereof is 1050° C. (see "Tre" in the figure), the mean "r" value is high. This is because, among the Nb-based precipitates (Nb(C,N) and the Laves phase), the Laves phase, in particular, precipitates in large enough quantity and size to accelerate recrystallization in the subsequent cold-rolled strip annealing process.

If the temperatures are outside the range specified by the present invention (the range PI in the figure), appropriate precipitates are unobtainable in the manufacturing process. As a consequence, the x-ray intensity ratio of cold-rolled steel strip is outside the preferable range and the preferable "r" value cannot be obtained.

If the hot-rolled steel strip is annealed at a temperature higher than 1000° C., much of the Nb-based precipitates becomes a solid solution and re-precipitates when the cold-rolled strip is annealed, thereby significantly delaying the recrystallization of the ferrite phase and impeding the growth of the recrystallization orientation that increases the "r" value.

If the hot-rolled strip is annealed at a temperature under 900° C., a large quantity of fine Laves phase not larger than 0.1 μm precipitates. In the subsequent annealing of the cold-rolled steel strip, the fine Laves phase acts as a pin to inhibit recrystallization and significantly delays the recrystallization of the ferrite phase.

In order to prevent the precipitation of the fine Laves phase during cold-rolling, the faster the cold-rolling rate, the better. The preferable cold-rolling rate is 30° C./sec or faster.

The recrystallizing temperature of the hot-rolled steel strip varies with the alloy composition. Depending on other properties, it is at times preferable to recrystallize the hot-rolled steel strip. The inventors discovered that heating to and holding between 900° C. and 1000° C. is effective because heat treatment is done at a temperature not lower than the recrystallizing temperature and the Laves phase described earlier is controlled subsequently.

Figure 4:
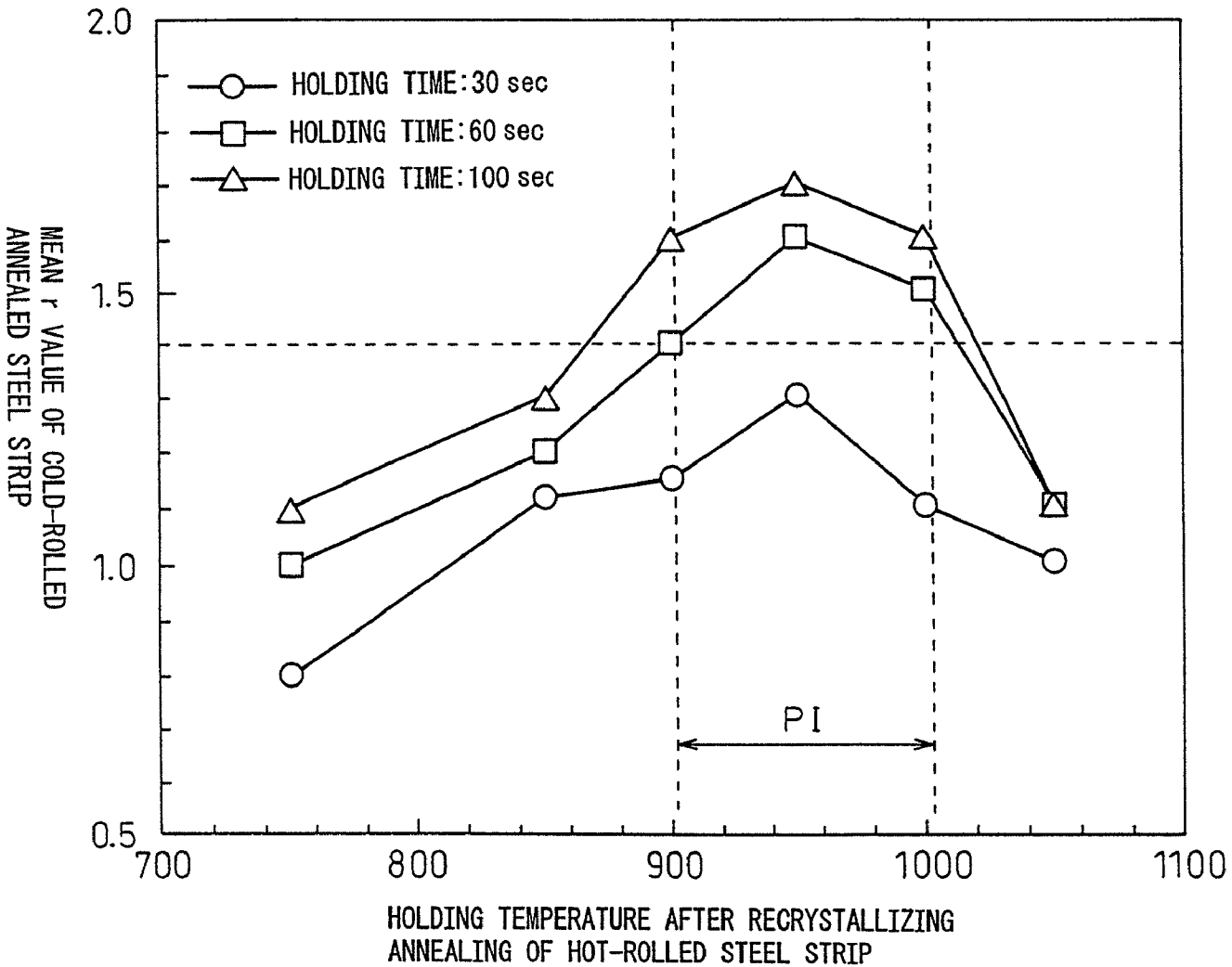
FIG. 4 shows the relationship between the annealing condition of hot-rolled strip and the "r" value of manufactured strip.

FIG. 4 shows the relationship between the holding time of hot-rolled strip annealing temperature and the mean "r" value of cold-rolled annealed steel strip prepared by annealing a hot-rolled strip of Cr-bearing heat-resistant steel (containing C of 0.003%, Si of 0.5%, Mn of 0.5%, P of 0.02%, S of 0.001%, Cr of 14.5%, Nb of 0.6%, Mo of 1.4% and N of 0.01%) and cold-rolling to 300° C. at a rate of 30° C./sec, with a slab heating temperature of 1150° C., coiling temperature of 500° C., hot-rolled strip thickness of 5.0 mm, hot-rolled strip heating temperature of 1100° C., cold-rolled strip thickness of 1.5 mm and cold-rolled strip annealing temperature of 1050° C.

As shown in FIG. 4, the mean "r" value of not lower than 1.4 is obtained if the strip is heated to a temperature range between 900° C. and 1000° C. and held in the same range for not shorter than 60 seconds. If the temperatures are outside the range specified by the present invention (the range PI in the figure), appropriate precipitates are unobtainable in the manufacturing process. As a consequence, the x-ray intensity ratio of cold-rolled steel strip is outside the preferable range and the preferable "r" value cannot be obtained.

Hot-rolled steel strip can be heated to a temperature not lower than the recrystallizing temperature either by continuous annealing that heat treats steel strip continuously or by batch annealing which requires long time. Heating to the temperature range between about 900° C. and 1000° C. can be accomplished either by first heating to the recrystallizing temperature and then reheating after cooling to room temperature or by holding in the cold-rolling process after heating to the recrystallizing temperature. In all these cases, the cold-rolling rate to 300° C. should be not slower than about 30° C./sec for the reason described above.

In order to control the quantity and size of Nb-based precipitates, hot-rolled steel strip can be heat-treated over a long period of time, as described earlier. Particularly if strip is held between 750° C. and 950° C. for 1 hour to 30 hours, Nb-precipitates are formed in an appropriate way to contribute to the improvement of workability. Heat treatment can be applied either by batch annealing or by holding the heat during coiling of hot-rolled strip. In view of the production efficiency, the preferable heat treatment temperature is about 800° C. to 900° C.

Examples of the exemplary embodiments of the present invention are described below. The conditions used in the examples are those which were used to demonstrate the practicability and effect of the present invention which is by no means limited thereto. The present invention can be put into practice under various conditions without departing from the spirit and purpose thereof.

EXAMPLE

Steels of chemical compositions listed in Tables 1 and 2 were cast to slab that was then hot-rolled to 5.0 mm thick strip. The hot-rolled strip was then continuously annealed, pickled, cold-rolled to a thickness of 1.5 mm, and then made into finished product by applying continuous annealing and pickling. Tables 3 and 4 shows the manufacturing conditions employed.

Specimens were taken from the finished product described above and the x-ray intensity, "r" value and elongation in the central region of thickness were measured. The x-ray intensity and "r" value were measured by the same method as described earlier.

Elongation at break was determined by taking JIS 13B tensile test specimens from the finished-strip and applying tensile force in the rolling direction. If the elongation is under 30%, the finished-strip does not withstand stretch forming even if the "r" value is high. Therefore, elongation must not be less than 30%.

TABLE 1

| Steel No. | C | Si | Mn | P | S | Cr | N | Nb | Mo | Cu | W | Sn | Ti | Al | Mg | B | X-ray intensity ratio {111}/({100} + {211}) of finished strip | Mean "r" value of finished strip | Elongation of finished strip, % |
|---|---|---|---|---|---|---|---|---|---|---|---|---|---|---|---|---|---|---|---|
| 1 | 0.005 | 0.53 | 0.55 | 0.03 | 0.0008 | 13.9 | 0.009 | 0.61 | 1.4 | — | — | — | — | — | — | — | 3.0 | 1.5 | 35 |
| 2 | 0.003 | 0.08 | 0.07 | 0.01 | 0.0001 | 14.5 | 0.005 | 0.58 | 1.5 | — | — | — | — | — | — | — | 2.5 | 1.4 | 32 |
| 3 | 0.004 | 0.11 | 0.13 | 0.01 | 0.0012 | 18.8 | 0.005 | 0.77 | 1.5 | — | — | — | — | — | — | — | 2.6 | 1.5 | 31 |
| 4 | 0.003 | 0.08 | 0.07 | 0.01 | 0.0001 | 14.5 | 0.005 | 0.83 | 1.5 | — | — | — | — | — | — | — | 3.0 | 1.6 | 34 |
| 5 | 0.003 | 0.49 | 0.52 | 0.02 | 0.0011 | 14.0 | 0.009 | 0.55 | 1.3 | 2.5 | — | — | — | — | — | — | 4.0 | 1.8 | 32 |
| 6 | 0.006 | 0.23 | 0.45 | 0.01 | 0.0015 | 18.5 | 0.004 | 0.63 | 1.5 | 1.5 | 0.14 | — | — | — | — | — | 4.2 | 1.8 | 31 |
| 7 | 0.008 | 0.58 | 0.56 | 0.04 | 0.0033 | 14.1 | 0.002 | 0.90 | 0.5 | — | — | 0.05 | — | — | — | — | 4.1 | 1.8 | 33 |
| 8 | 0.007 | 0.45 | 0.31 | 0.02 | 0.0023 | 16.8 | 0.006 | 0.53 | 0.6 | 0.8 | — | 0.08 | — | — | — | — | 3.8 | 1.7 | 33 |
| 9 | 0.008 | 0.50 | 0.50 | 0.01 | 0.0016 | 14.3 | 0.001 | 0.66 | 1.1 | 0.6 | 0.09 | — | — | — | — | — | 2.8 | 1.5 | 32 |
| 10 | 0.009 | 0.07 | 0.09 | 0.01 | 0.0010 | 15.5 | 0.015 | 0.35 | 2.9 | — | 0.70 | 0.70 | — | — | — | — | 2.9 | 1.6 | 31 |
| 11 | 0.002 | 0.07 | 0.06 | 0.03 | 0.0007 | 14.6 | 0.016 | 0.33 | 0.6 | — | — | — | 0.11 | — | — | 0.0005 | 3.3 | 1.7 | 36 |
| 12 | 0.007 | 0.58 | 0.33 | 0.01 | 0.0053 | 15.8 | 0.011 | 0.45 | 0.7 | — | — | — | | 0.010 | | — | 4.1 | 1.8 | 35 |
| 13 | 0.004 | 0.35 | 0.25 | 0.01 | 0.0025 | 16.3 | 0.008 | 0.56 | 1.1 | — | — | — | — | — | 0.0002 | — | 4.5 | 1.9 | 38 |
| 14 | 0.005 | 0.26 | 0.41 | 0.01 | 0.0013 | 17.8 | 0.013 | 0.68 | 1.6 | — | — | — | 0.03 | 0.07 | | 0.0003 | 2.5 | 1.5 | 35 |
| 15 | 0.006 | 0.15 | 0.11 | 0.02 | 0.0021 | 18.6 | 0.005 | 0.77 | 1.9 | — | — | — | 0.18 | — | 0.0011 | — | 2.4 | 1.4 | 36 |
| 16 | 0.009 | 0.06 | 0.09 | 0.01 | 0.0015 | 18.3 | 0.003 | 0.81 | 1.4 | — | — | — | | 0.006 | 0.0005 | — | 3.9 | 1.7 | 35 |
| 17 | 0.006 | 0.38 | 0.45 | 0.04 | 0.0009 | 17.1 | 0.004 | 0.93 | 1.2 | 0.7 | — | — | 0.02 | — | — | 0.0010 | 4.5 | 1.8 | 35 |
| 18 | 0.003 | 0.21 | 0.55 | 0.02 | 0.0011 | 16.2 | 0.001 | 0.83 | 1.1 | 2.8 | — | — | 0.17 | 0.006 | — | 0.0008 | 3.3 | 1.6 | 34 |
| 19 | 0.003 | 0.13 | 0.22 | 0.01 | 0.0019 | 15.4 | 0.013 | 0.74 | 0.7 | — | — | — | 0.03 | — | 0.0002 | 0.0005 | 3.2 | 1.6 | 35 |
| 20 | 0.003 | 0.12 | 0.39 | 0.01 | 0.0038 | 14.2 | 0.018 | 0.61 | 0.6 | — | 0.05 | 0.12 | 0.15 | — | — | 0.0004 | 2.5 | 1.5 | 32 |
| 21 | 0.003 | 0.02 | 0.1 | 0.02 | 0.001 | 16.1 | 0.011 | 0.47 | 1.7 | — | — | — | 0.15 | 0.013 | 0.0002 | 0.0008 | 3.0 | 1.5 | 35 |
| 22 | 0.004 | 0.11 | 0.16 | 0.03 | 0.0041 | 14.1 | 0.004 | 0.55 | 0.5 | 1.4 | — | — | 0.09 | — | 0.0050 | 0.0009 | 3.1 | 1.6 | 34 |

TABLE 2

| Steel No. | C | Si | Mn | P | S | Cr | N | Nb | Mo | Cu | W | Sn |
|---|---|---|---|---|---|---|---|---|---|---|---|---|
| 23 | 0.005 | 0.53 | 0.55 | 0.03 | 0.0008 | 13.9 | 0.009 | 0.61 | 1.4 | — | — | — |
| 24 | 0.006 | 0.8* | 0.35 | 0.02 | 0.0009 | 14.3 | 0.001 | 0.60 | 1.3 | — | — | — |
| 25 | 0.007 | 0.42 | 1.2* | 0.02 | 0.0012 | 14.5 | 0.001 | 0.59 | 1.4 | — | — | — |
| 26 | 0.003 | 0.55 | 0.07 | 0.01 | 0.0001 | 14.5 | 0.005 | 0.58 | 1.5 | — | — | — |
| 27 | 0.004 | 0.11 | 0.60 | 0.01 | 0.0012 | 18.8 | 0.005 | 0.77 | 1.5 | — | — | — |
| 28 | 0.003 | 0.08 | 0.07 | 0.05* | 0.0004 | 14.5 | 0.005 | 0.83 | 1.5 | — | — | — |
| 29 | 0.003 | 0.49 | 0.52 | 0.02 | 0.0015 | 14.0 | 0.009 | 0.55 | 1.3 | — | — | — |
| 30 | 0.005 | 0.33 | 0.42 | 0.03 | 0.023* | 14.1 | 0.001 | 0.65 | 1.5 | — | — | — |
| 31 | 0.006 | 0.23 | 0.45 | 0.01 | 0.0015 | 20.5* | 0.004 | 0.63 | 1.5 | — | — | — |
| 32 | 0.008 | 0.58 | 0.56 | 0.04 | 0.0033 | 14.1 | 0.025* | 0.90 | 0.5 | — | — | — |
| 33 | 0.007 | 0.45 | 0.31 | 0.02 | 0.0023 | 16.8 | 0.006 | 1.3* | 0.6 | — | — | — |
| 34 | 0.009 | 0.55 | 0.29 | 0.03 | 0.0013 | 16.5 | 0.017 | 0.25* | 1.1 | — | — | — |
| 35 | 0.007 | 0.45 | 0.31 | 0.02 | 0.0023 | 16.8 | 0.006 | 0.31 | 0.6 | — | — | — |
| 36 | 0.008 | 0.50 | 0.50 | 0.01 | 0.0016 | 14.3 | 0.001 | 0.66 | 2.4* | — | — | — |
| 37 | 0.009 | 0.44 | 0.55 | 0.03 | 0.0022 | 14.5 | 0.012 | 0.51 | 0.4* | — | — | — |
| 38 | 0.002 | 0.07 | 0.06 | 0.03 | 0.0007 | 14.6 | 0.016 | 0.33 | 0.6 | 3.8* | — | — |
| 39 | 0.005 | 0.35 | 0.55 | 0.03 | 0.0011 | 14.1 | 0.013 | 0.41 | 0.7 | 0.4* | — | — |
| 40 | 0.004 | 0.35 | 0.25 | 0.01 | 0.0025 | 16.3 | 0.008 | 0.56 | 1.1 | — | 1.5* | — |
| 41 | 0.006 | 0.15 | 0.11 | 0.02 | 0.0021 | 18.6 | 0.005 | 0.77 | 1.9 | — | — | 1.5* |

TABLE 2-continued

| | | | | | | | | | | | | |
|---|---|---|---|---|---|---|---|---|---|---|---|---|
| 42 | 0.005 | 0.23 | 0.25 | 0.02 | 0.0023 | 14.5 | 0.015 | 0.44 | 1.5 | 1.2 | — | 0.02* |
| 43 | 0.006 | 0.38 | 0.45 | 0.04 | 0.0009 | 17.1 | 0.004 | 0.93 | 1.2 | — | — | — |
| 44 | 0.008 | 0.22 | 0.36 | 0.04 | 0.0023 | 16.9 | 0.0016 | 0.65 | 1.1 | — | — | — |
| 45 | 0.003 | 0.13 | 0.22 | 0.01 | 0.0019 | 15.4 | 0.013 | 0.74 | 0.7 | — | — | — |
| 46 | 0.004 | 0.11 | 0.16 | 0.03 | 0.0041 | 14.1 | 0.004 | 0.55 | 0.5 | — | — | — |
| 47 | 0.005 | 0.25 | 0.25 | 0.03 | 0.0035 | 14.3 | 0.011 | 0.45 | 0.5 | — | — | — |
| 48 | 0.003 | 0.04 | 0.1 | 0.02 | 0.001 | 16.1 | 0.011 | 0.47 | 1.7 | — | — | — |

| Steel No. | Ti | Al | Mg | B | X-ray intensity ratio {111}/({100} + {211}) of finished strip | Mean "r" value of finished strip | Elongation of finished strip, % |
|---|---|---|---|---|---|---|---|
| 23 | — | — | — | — | 1.7* | 1.2* | 27* |
| 24 | — | — | — | — | 2.5 | 1.4 | 28* |
| 25 | — | — | — | — | 2.5 | 1.3 | 27* |
| 26 | — | — | — | — | 1.5* | 1* | 32 |
| 27 | — | — | — | — | 1* | 0.9* | 33 |
| 28 | — | — | — | — | 2.5 | 1.4 | 29* |
| 29 | — | — | — | — | 1.6* | 1.1* | 34 |
| 30 | — | — | — | — | 2.6 | 1.5 | 26* |
| 31 | — | — | — | — | 1.9* | 1.3 | 28* |
| 32 | — | — | — | — | 0.5* | 0.6* | 28* |
| 33 | — | — | — | — | 1.5* | 1.1* | 24* |
| 34 | — | — | — | — | 1.6* | 1.2* | 31 |
| 35 | — | — | — | — | 1.4* | 1* | 32 |
| 36 | — | — | — | — | 1.1* | 0.8* | 25* |
| 37 | — | — | — | — | 1.6* | 1.2* | 32 |
| 38 | — | — | — | — | 2.2 | 1.5* | 29* |
| 39 | — | — | — | — | 1.8* | 1.3* | 33 |
| 40 | — | — | — | — | 1.4* | 1* | 23* |
| 41 | — | — | — | — | 1* | 0.8* | 24* |
| 42 | — | — | — | — | 1.1* | 0.9* | 33 |
| 43 | 0.38* | — | — | — | 1.8* | 1.3* | 28* |
| 44 | 0.005* | — | — | — | 1.7* | 1.3* | 32 |
| 45 | — | 0.16* | — | — | 2.1 | 1.4 | 29* |
| 46 | — | — | 0.013* | — | 3.0 | 1.5 | 29* |
| 47 | — | — | 0.0001* | — | 1.9 | 1.3* | 33 |
| 48 | 0.15 | 0.013 | 0.0002 | 0.0021* | 1.7* | 1.2* | 26* |

*Outside the scope of the present invention

TABLE 3

| | | Hot-rolling conditions | | | Hot-rolled strip annealing conditions | | | | X-ray intensity ratio | Mean "r" | Elongation |
|---|---|---|---|---|---|---|---|---|---|---|---|
| | Steel No. | Heating temperature, ° C. | Finishing temperature, ° C. | Coiling temperature, ° C. | Heating temperature, ° C. | Holding temperature, ° C. | Holding time, sec | Cold-rolling rate, ° C./sec | {111}/({100} + {211}) of finished strip | value of finished strip | of finished strip, % |
| inventive Examples | 49 | 1150 | 790 | 490 | 950 | non | — | 30 | 2.0 | 1.4 | 35 |
| | 50 | 1090 | 730 | 450 | 950 | non | — | 40 | 2.2 | 1.5 | 36 |
| | 51 | 1030 | 650 | 300 | 910 | non | — | 80 | 2.3 | 1.6 | 35 |
| | 52 | 1150 | 800 | 450 | 1080 | 950 | 60 | 40 | 3.3 | 1.8 | 36 |
| | 53 | 1050 | 780 | 500 | 1100 | 1000 | 70 | 30 | 2.8 | 1.6 | 35 |
| | 54 | 1020 | 630 | 475 | 1050 | 930 | 60 | 50 | 3.0 | 1.7 | 36 |
| | 55 | 1150 | 650 | 460 | 950 | non | — | 35 | 3.0 | 1.7 | 32 |
| | 56 | 1100 | 660 | 450 | 1100 | 950 | 100 | 40 | 3.0 | 1.7 | 32 |
| | 57 | 1140 | 730 | 500 | 980 | non | — | 40 | 2.0 | 1.4 | 31 |
| | 58 | 1130 | 750 | 310 | 1100 | 950 | 120 | 30 | 3.1 | 1.7 | 33 |
| | 59 | 1150 | 796 | 350 | 1020 | non | — | 50 | 2.3 | 1.5 | 36 |
| | 60 | 1110 | 710 | 500 | 1100 | 950 | 180 | 60 | 3.2 | 1.8 | 36 |
| | 61 | 1060 | 630 | 470 | 1030 | non | — | 30 | 2.7 | 1.6 | 35 |
| | 62 | 1050 | 620 | 410 | 1100 | 940 | 60 | 70 | 3.2 | 1.8 | 36 |
| | 63 | 1030 | 645 | 360 | 930 | non | — | 100 | 3.1 | 1.7 | 35 |
| | 64 | 1150 | 730 | 425 | 1100 | 990 | 60 | 30 | 2.7 | 1.6 | 34 |
| | 65 | 1020 | 740 | 430 | 940 | non | — | 60 | 2.0 | 1.4 | 32 |
| | 66 | 1030 | 625 | 500 | 1100 | 930 | 200 | 40 | 3.5 | 1.9 | 34 |
| | 67 | 1010 | 635 | 486 | 950 | non | — | 80 | 3.3 | 1.8 | 34 |
| | 68 | 1030 | 680 | 485 | 1100 | 980 | 100 | 90 | 2.0 | 1.7 | 33 |
| | 69 | 1150 | 790 | 490 | — | 850 | 21600 | 50° C./hr | 2.0 | 1.4 | 35 |
| | 70 | 1150 | 790 | 490 | — | 750 | 108000 | 40° C./hr | 2.2 | 1.5 | 36 |

TABLE 4

| | Steel No. | Hot-rolling conditions: Heating temperature, ° C. | Hot-rolling conditions: Finishing temperature, ° C. | Hot-rolling conditions: Coiling temperature, ° C. | Hot-rolled strip annealing conditions: Heating temperature, ° C. | Hot-rolled strip annealing conditions: Holding temperature, ° C. | Hot-rolled strip annealing conditions: Holding time, sec | Hot-rolled strip annealing conditions: Cold-rolling rate, ° C./sec | X-ray intensity ratio {111}/({100} + {211}) of finished strip | Mean "r" value of finished strip | Elongation of finished strip, % |
|---|---|---|---|---|---|---|---|---|---|---|---|
| relative examples | 71 | 1200* | 790 | 490 | 950 | non | — | 40 | 1.1* | 1.1* | 34 |
| | 72 | 1150 | 860* | 490 | 1000 | non | — | 50 | 1.3* | 1.2* | 33 |
| | 73 | 1150 | 790 | 650* | 1100 | 950 | 100 | 60 | 1.2* | 1.2* | 35 |
| | 74 | 1130 | 770 | 490 | 1050* | non | — | 30 | 1.1* | 1.2* | 31 |
| | 75 | 1150 | 750 | 490 | 1000 | non | — | 15* | 1.3* | 1.3* | 32 |
| | 76 | 1140 | 790 | 490 | 1080 | 1030* | 60 | 30 | 1* | 1* | 31 |
| | 77 | 1050 | 720 | 490 | 1050 | 850* | 130 | 20* | 1.1* | 1.2* | 30 |
| | 78 | 1150 | 650 | 500 | 870* | non | — | 30 | 0.9* | 0.9* | 31 |
| | 79 | 1160 | 690 | 450 | 1100 | 1050* | 200 | 40 | 1.2* | 1.1* | 32 |
| | 80 | 1050 | 800 | 450 | 1050* | non | — | 80 | 1.3* | 1.2* | 31 |
| | 81 | 1100 | 760 | 480 | 1080 | 1020* | 300 | 40 | 1.2* | 1.1* | 30 |
| | 82 | 1060 | 780 | 470 | 1030* | non | — | 30 | 1.2* | 1.3* | 35 |
| | 83 | 1030 | 750 | 440 | 1050 | 1010* | 120 | 50 | 1* | 1* | 33 |
| | 84 | 1050 | 800 | 500 | 1100* | non | — | 35 | 1.2* | 1.1* | 34 |
| | 85 | 1140 | 630 | 470 | 1090 | 1050* | 110 | 20* | 1.5* | 1.2* | 33 |
| | 86 | 1150 | 760 | 440 | 1120* | non | — | 40 | 1.3* | 1* | 34 |
| | 87 | 1130 | 770 | 420 | 1100 | 870* | 70 | 30 | 0.8* | 0.9* | 32 |
| | 88 | 1100 | 800 | 450 | 770* | non | — | 50 | 0.5* | 0.6* | 30 |
| | 89 | 1100 | 630 | 460 | 1150 | 830* | 300 | 20* | 0.9* | 0.9* | 32 |
| | 90 | 1100 | 700 | 450 | 1060* | non | — | 40 | 1.1* | 1.1* | 33 |
| | 91 | 1100 | 700 | 430 | 1100 | 750* | 160 | 30 | 0.6* | 0.7* | 32 |
| | 92 | 1150 | 790 | 490 | — | 850 | 1800* | 50° C./hr | 1.1* | 1.1* | 34 |
| | 93 | 1150 | 790 | 490 | — | 750 | 1200* | 40° C./hr | 1.3* | 1.2* | 33 |

*Outside the scope of the present invention

Provided below are the findings obtained from Tables 1 and 2. The finished-strips manufactured from the steels of the compositions according to the present invention have higher mean "r" values and better workability than the strips prepared for comparison. Even if chemical composition is within the range of the present invention, preferable x-ray intensity is not obtained and, therefore, the "r" value does not improve if the x-ray intensity ratio is outside the range of the present invention.

If Si, Mn, P, S, Cu and Ti contents exceed the upper limit thereof, not many precipitates, that affect the x-ray intensity, are formed. Although, therefore, the x-ray intensity and "r" value are within the range according to the invention, elongation drops significantly because of solid solution strengthening and intergranular segregation.

If C and N contents exceed the upper limit thereof, solid solutions of C and N increase. As a consequence, the desired x-ray intensity is not obtained and elongation drops. Cr, Nb, Mo, Sn and W form intermetallic compounds and segregate at grain boundaries. If, therefore, their contents exceed the upper limit specified by the invention, the desired x-ray intensity and elongation are not obtained because of plentiful precipitation of fine precipitates and solid solution strengthening.

If Nb and Mo contents fall below the lower limit thereof specified by the exemplary embodiments of the present invention, sufficient precipitation of the Laves phase and sufficient fixing of C and N are not achieved. As a consequence, the x-ray intensity drops and the desired "r" value is unobtainable. Excessive addition of Mg, though the influence on the x-ray intensity is small, makes the precipitates and oxides too coarse and, therefore, brings about a drop in elongation.

Tables 3 and 4 show the influences of manufacturing conditions. The finished-strips manufactured by the methods according to this invention have the mean "r" values not lower than 1.4 and the x-ray intensity ratios not lower than 2 that provide excellent workability.

If manufacturing conditions are outside the range according to the present invention, appropriate precipitates are not formed in the manufacturing process. As a consequence, the preferable x-ray intensity and "r" value are not obtained in cold-rolled annealed steel strip.

The thicknesses of slabs and hot-rolled strips can be chosen appropriately. The reduction ratio, roll surface roughness, roll diameter, rolling oil, rolling passes, rolling speed and rolling temperature in cold-rolling can also be appropriately chosen.

Employment of a double rolling method, which applies intermediate annealing midway through cold-rolling further improves the properties of finished steel strip. Intermediate and final annealing can be applied either by bright annealing, which is implemented in non-oxidizing atmosphere such as hydrogen or nitrogen gas, or by annealing in the atmosphere.

INDUSTRIAL APPLICABILITY

The exemplary embodiments of the present invention efficiently provides Cr-bearing heat-resistant steel strip having an excellent workability without requiring any new facilities. Accordingly, these exemplary embodiments of the present invention provide a great industrial applicability.

The invention claimed is:

1. Cr-bearing heat-resistant steel sheet portion with a particular workability comprising, in mass %:

C of 0.001% to 0.010%, Si of 0.01% to 0.60%, Mn of 0.05% to 0.6%, P of 0.01% to 0.04%, S of 0.0005% to 0.0100%, Cr of 14% to 19%, N of 0.001% to 0.020%, Nb of 0.3% to 1.0%, Mo of 0.5% to 2.0%, with a reminder comprising iron and unavoidable impurities; and an x-ray intensity ration {111}/({100}+{211}) of at least 2 in a central region of thickness of the portion.

2. The Cr-bearing heat-resistant steel sheet according to claim 1, further comprising, in mass %, at least one of Cu of 0.5% to 3.0%, W of 0.01% to 1.0%, and Sn of 0.01% to 1.00%.

3. The Cr-bearing heat-resistant steel sheet according to claim 1, further comprising, in mass %, at least one of Ti of 0.01% to 0.2%, Al of 0.005% to 0.100%, Mg of 0.0002% to 0.0100%, and B of 0.0003% to 0.001%.

4. Cr-bearing heat-resistant steel sheet portion with a particular workability comprising, in mass %:

C of 0.001% to 0.010%, Si of 0.01% to 0.60%, Mn of 0.05% to 0.6%, P of 0.01% to 0.04%, 5 of 0.0005% to 0.0100%, Cr of 14% to 19%, N of 0.001% to 0.020%, Nb of 0.53% to 1.0%, Mo of 0.5% to 2.0%, with a reminder comprising iron and unavoidable impurities; and an x-ray intensity ration {111}/({100}+{211}) of at least 2 in a central region of thickness of the portion.

5. The Cr-bearing heat-resistant steel sheet according to claim 1, further comprising, in mass %, at least one of Cu of 0.5% to 3.0%, W of 0.01% to 1.0%, and Sn of 0.01% to 1.00%.

6. The Cr-bearing heat-resistant steel sheet according to claim 1, further comprising, in mass %, at least one of Ti of 0.01% to 0.2%, Al of 0.005% to 0.100%, Mg of 0.0002% to 0.0 100%, and B of 0.0003% to 0.001%.

* * * * *

UNITED STATES PATENT AND TRADEMARK OFFICE

CERTIFICATE OF CORRECTION

PATENT NO. : 7,682,559 B2
APPLICATION NO. : 10/504453
DATED : March 23, 2010
INVENTOR(S) : Junichi Hamada et al.

It is certified that error appears in the above-identified patent and that said Letters Patent is hereby corrected as shown below:

ON THE TITLE PAGE:

--Item (73) Assignee: Nippon Steel Corporation, Tokyo (JP)

should read

--Item (73) Assignee: Nippon Steel & Sumikin Stainless Steel Corporation, Tokyo (JP)

Signed and Sealed this

Twenty-third Day of November, 2010

David J. Kappos

David J. Kappos
*Director of the United States Patent and Trademark Office*